US008854160B2

(12) United States Patent
Park et al.

(10) Patent No.: US 8,854,160 B2
(45) Date of Patent: Oct. 7, 2014

(54) DIELECTRIC RESONATOR FIXED BY A PRESSING METAL PLATE AND METHOD OF ASSEMBLY

(75) Inventors: Nam-Shin Park, Gyeonggi-do (KR); Sung-Kyun Kim, Gyeonggi-do (KR); Jung-Hyun Kwon, Gyeonggi-do (KR)

(73) Assignee: KMW Inc., Hwaseong, Gyeonggi-Do (KR)

( * ) Notice: Subject to any disclaimer, the term of this patent is extended or adjusted under 35 U.S.C. 154(b) by 692 days.

(21) Appl. No.: 13/056,770

(22) PCT Filed: Jul. 31, 2009

(86) PCT No.: PCT/KR2009/004314

§ 371 (c)(1),
(2), (4) Date: Jan. 31, 2011

(87) PCT Pub. No.: WO2010/013982

PCT Pub. Date: Feb. 4, 2010

(65) Prior Publication Data

US 2011/0128097 A1 Jun. 2, 2011

(30) Foreign Application Priority Data

Aug. 1, 2008 (KR) ..... 10-2008-0075643
Mar. 6, 2009 (KR) ..... 10-2009-0019500

(51) Int. Cl.
*H01P 7/10* (2006.01)

(52) U.S. Cl.
CPC ..... *H01P 7/10* (2013.01)
USPC ..... 333/219.1; 333/235

(58) Field of Classification Search
CPC ..... H01P 7/10
USPC ..... 333/202, 219.1, 235
See application file for complete search history.

(56) References Cited

U.S. PATENT DOCUMENTS

| | | | | |
|---|---|---|---|---|
| 3,973,226 | A | 8/1976 | Affolter et al. | |
| 6,535,086 | B1 * | 3/2003 | Liang et al. | 333/219.1 |
| 2005/0030131 | A1 * | 2/2005 | Yamakawa et al. | 333/202 |
| 2010/0308937 | A1 * | 12/2010 | Myllyvainio et al. | 333/202 |

FOREIGN PATENT DOCUMENTS

| | | | | |
|---|---|---|---|---|
| JP | 63-250201 | A | 10/1988 | |
| JP | 1995-066611 | | 3/1995 | H01P 7/10 |
| JP | 11-067612 | A | 3/1999 | |

(Continued)

OTHER PUBLICATIONS

Andoh, Masamichi, et al.; Patent Application Publication No. US 2004/0178864 A1; Publication Date: Sep. 16, 2004; "Dielectric Resonator Device, Dielectric Filter, Composite Dielectric Filter . . . ;".

*Primary Examiner* — Benny Lee
(74) *Attorney, Agent, or Firm* — Edwards Wildman Palmer LLP

(57) ABSTRACT

A dielectric resonator in a radio frequency filter is provided, in which a dielectric resonance element is fixed at the center of a housing space formed by a cover and a housing, a guide groove is formed into a bottom of the housing, for allowing the dielectric resonance element to be inserted therein, a metal plate is interposed between the cover and the housing, and a dielectric fixing screw is engaged with the cover at a position corresponding to an upper end portion of the dielectric resonance element by screwing, for fixing the dielectric resonance element by pressing the upper end portion of the dielectric resonance element.

11 Claims, 3 Drawing Sheets

(56) References Cited

FOREIGN PATENT DOCUMENTS

| | | | |
|---|---|---|---|
| JP | 2000-165118 | 6/2000 | ..... H01P 7/10 |
| JP | 2002-158514 A | 5/2002 | |
| JP | 2004-297774 A | 10/2004 | |
| JP | 2005-033327 | 2/2005 | ..... H01P 1/20 |
| JP | 2005-223665 | 8/2005 | ..... H01P 1/20 |
| JP | 2005-244508 A | 9/2005 | |
| KR | 2001-112893 | 12/2001 | ..... H01P 1/20 |

* cited by examiner

Figure 1 [PRIOR ART]
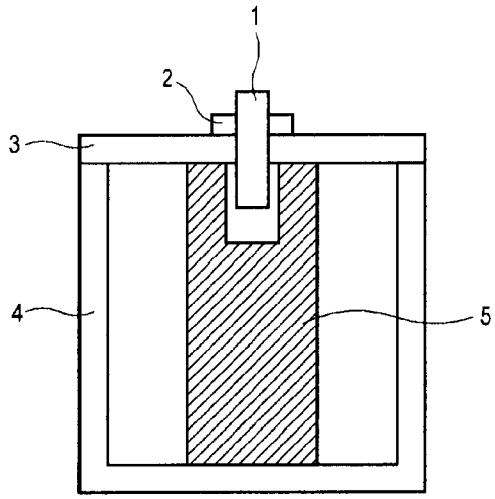
Figure 2 [PRIOR ART]
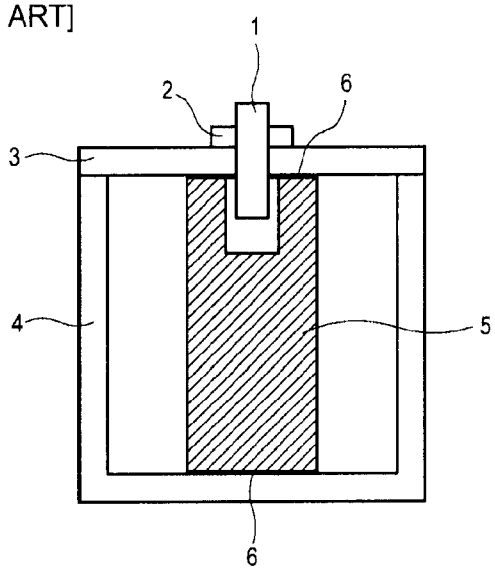
Figure 3
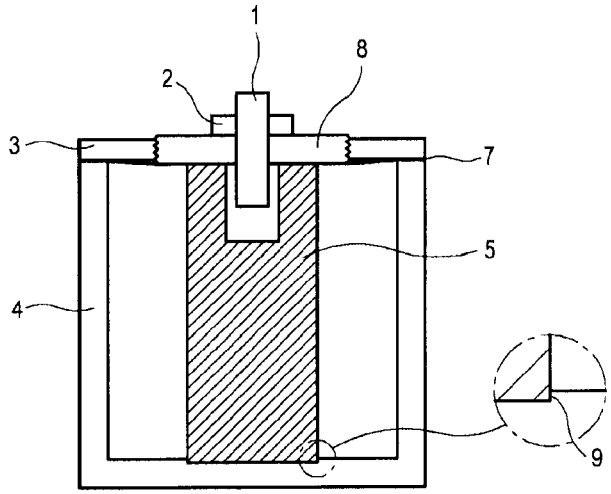

DIELECTRIC RESONATOR FIXED BY A PRESSING METAL PLATE AND METHOD OF ASSEMBLY

This application makes reference to and claims all benefits from an application entitled DIELECTRIC RESONATOR IN RF FILTER AND ASSEMBLY METHOD THEREFOR filed in the Korean Intellectual Property Office on Jul. 31, 2009 and there duly assigned PCT/KR2009/004314.

BACKGROUND (a) Field of the Invention

The present invention generally relates to a Radio Frequency (RF) filter. More particularly, the present invention relates to a dielectric resonator in an RF filter.

(b) Description of the Related Art

An RF filter (e.g. a Dielectric Resonator (DR) filter, a cavity filter, a waveguide filter, etc.) has a kind of circuit cylinder structure for resonating at a radio frequency or ultra radio frequency. A typical coil-condenser resonant circuit is not suitable for generating an ultra radio frequency due to a large radiation loss. The RF filter has a plurality of resonators each forming a metal cylindrical or rectangular cavity coated with a conductive material and a dielectric resonance element or a resonance element configured to be a metal resonance rod is provided in the cavity. The resulting existence of an electromagnetic field only at a unique frequency makes ultra radio frequency resonance possible.

RF filters may be categorized into Transverse Magnetic (TM) mode, Transverse Electro Magnetic (TEM) mode, and Transverse Electric (TE) mode according to their resonator structures. An exemplary TM-mode resonator with excellent Quality factor (Q) characteristics is disclosed in U.S. Pat. No. 7,106,152 entitled "Dielectric Resonator, Dielectric Filter, and Method of Supporting Dielectric Resonance Element" by Takehiko Yamakawa, et. al. for which a patent was granted on Sep. 12, 2006.

Compared to a conventional TEM-mode resonator (a cavity filter structure), since a TM-mode resonator has a high Q value, it has Q characteristics improved by 40% for the same size. Owing to these characteristics, the TM-mode resonator filter can be designed to be much smaller, to have less insertion loss for the same size, and to have better attenuation characteristics than the TEM-mode resonator filter.

Although a TE01δ-mode resonator filter has a three times higher Q value than the TEM-mode resonator filter, it requires a few times higher fabrication cost and a huge volume. That's why the use of the TE01δ-mode resonator filter was restrictive to a Base Station (BS) high-power filter. Thus, the TE01δ-mode resonator filter is not feasible for small-size products.

FIG. 1 illustrates the structure of a conventional TM-mode resonator. Referring to FIG. 1, the conventional TM-mode resonator has a dielectric resonance element 5 at the center of a housing space defined by a metal cover 3 and a housing 4. Notably, both end surfaces of the dielectric resonance element 5 are brought into close contact with inner upper and lower surfaces of the housing space. A tuning groove may be formed at an upper end portion of the dielectric resonance element 5 and a tuning screw 1 and a fixing nut 2 are installed at a position corresponding to the tuning groove, for frequency tuning.

In this structure, it is very significant to assemble the dielectric resonance element 5 so that both end surfaces of the DR element 5 closely contact the inner upper and lower surfaces of the housing space. If the assembly is not done reliable, the characteristics of the TM-mode resonator are greatly changed with temperature changes, making it impossible to apply the TM-mode resonator to commercial products.

To avert this problem, metal coatings 6 are typically formed on both ends of the dielectric resonance element 5 and then the dielectric resonance element 5 is combined with the housing 4 and the cover 3 by soldering or an adhesive, or by any other method, as illustrated in FIG. 2.

The TM-mode resonator may be fabricated by use of a metal plate and other accessories instead of the metal coatings. However, it is difficult to assemble all dielectric resonance elements of the RF filter with the same force due to the processing tolerances of the dielectric resonance elements and the housing, thus making fabrication difficult. Especially since the dielectric resonance elements and the housing have different thermal expansion coefficients, the fixed or contact states of the dielectric resonance elements become poor and filter characteristics change, due to their contraction and expansion with temperature changes.

SUMMARY

An aspect of exemplary embodiments of the present invention is to address at least the problems and/or disadvantages and to provide at least the advantages described below. Accordingly, an aspect of exemplary embodiments of the present invention is to provide a dielectric resonator which has stable characteristics with respect to temperature changes, has an excellent Q value, and is stable in structure, and an assembly method therefor.

In accordance with another aspect of exemplary embodiments of the present invention, there is provided a method for assembling a dielectric resonator in a radio frequency filter, in which a rod-shaped dielectric resonance element is fixedly inserted into a guide groove formed into a bottom of a housing at the center of a housing space formed by a cover and the housing, a metal plate is interposed between the cover and the housing and engaging the cover with the housing, a dielectric fixing screw is tightened with a predetermined torque, the dielectric fixing screw being screwed with the cover at a position corresponding to an upper end portion of the dielectric resonance element, so as to press the upper end portion of the dielectric resonance element through the metal plate, and performing annealing at a predetermined high temperature for a predetermined time.

If the dielectric resonance element is assembled in the above manner after metalizing both ends of the dielectric resonance element, the annealing is not necessary. In this case, processing is facilitated and characteristics can be maintained stable without soldering.

As is apparent from the above description, a DR for an RF filter according to the present invention has stable temperature characteristics, compared to a conventional TM-mode resonator. The DR is robust against an external impact and thus its characteristics are maximized with low cost.

In the case where the overall temperature characteristics of the resonator are difficult to adjust due to fixed thermal expansion coefficients of a dielectric and a metal housing, desired temperature characteristics can be achieved by changing the material or predetermined torque of a dielectric fixing screw.

BRIEF DESCRIPTION OF THE DRAWINGS

The above and other objects, features and advantages of certain exemplary embodiments of the present invention will be more apparent from the following detailed description taken in conjunction with the accompanying drawings, in which:

FIGS. 1 and 2 illustrate exemplary structures of conventional TM-mode resonators;

FIG. 3 illustrates the structure of a TM-mode resonator according to an exemplary embodiment of the present invention;

Throughout the drawings, the same drawing reference numerals will be understood to refer to the same elements, features and structures.

DETAILED DESCRIPTION

The matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 4:
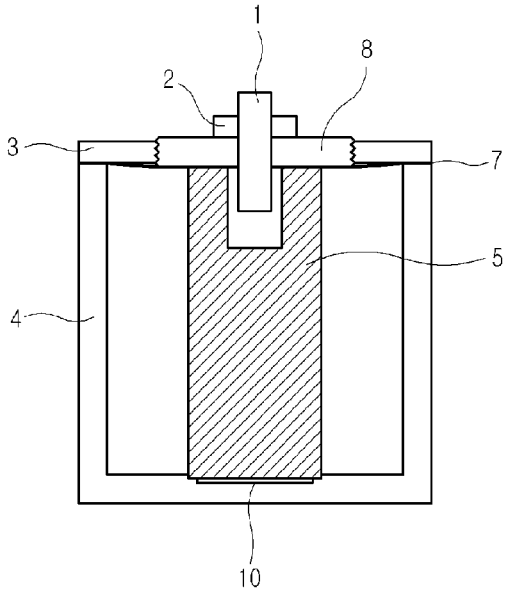
FIG. 4 illustrates an exemplary modification of the TM-mode resonator illustrated in FIG. 3.
Figure 5:
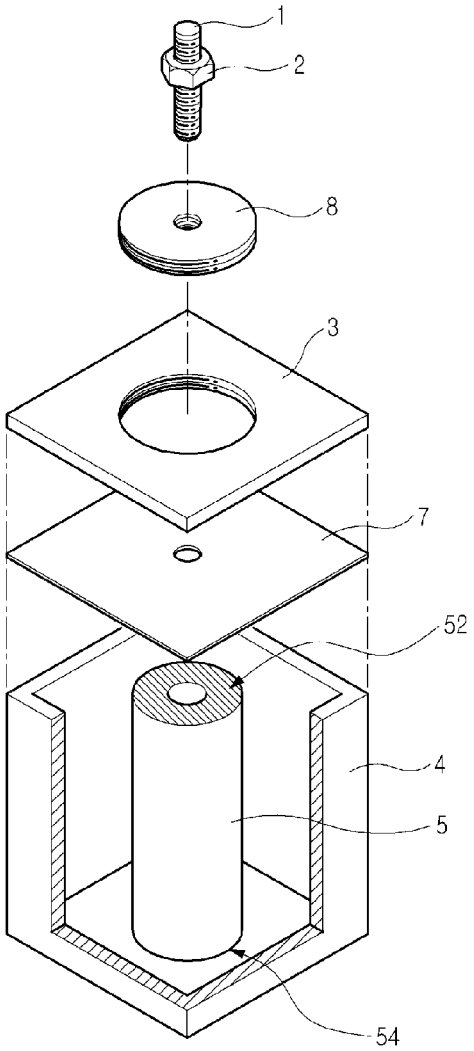
FIG. 5 is an exploded perspective view of the TM-mode resonator illustrated in FIG. 3.

FIG. 3 illustrates the structure of a TM-mode resonator according to an exemplary embodiment of the present invention, FIG. 4 illustrates an exemplary modification of the TM-mode resonator illustrated in FIG. 3, and FIG. 5 is an exploded perspective view of the TM-mode resonator illustrated in FIG. 3.

Referring to FIGS. 3, 4 and 5, the TM-mode resonator according to the present invention has the dielectric resonance element 5 in the shape of a rod at the center of the housing space formed by the metal cover 3 and the housing 4 and both end surfaces of the dielectric resonance element 5 are brought into close contact with the inner upper and lower surfaces of the housing space, like a conventional TM-mode resonator.

Compared to the conventional TM-mode resonator, the dielectric resonance element 5 is inserted into the bottom of the housing 4 and a guide groove 9, as illustrated in FIG. 3, is formed to protect an assembled portion of the dielectric resonance element 5 against a lateral impact. Also, a metal plate 7 is interposed between the housing 4 and the cover 3. The metal plate 7 is formed of a soft metal such as an aluminum or copper family. The cover 3 is provided with a dielectric fixing screw 8 for screwing with the cover 3 at a predetermined position of an upper end portion of the dielectric resonance element 5 and fixing the dielectric resonance element 5 by pressing the upper end portion of the dielectric resonance element 5 through use of the metal plate 7.

According to an exemplary embodiment of the present invention, metal coatings of silver or the like 52 and 54 of FIG. 5 may be formed on the upper and end surfaces of the dielectric resonance element 5, for example, by plating.

The dielectric fixing screw 8 is configured so as to be screw-engaged with the tuning screw 1 for frequency tuning at a position corresponding to the tuning groove formed on the upper end portion of the dielectric resonance element 5 and the tuning screw 1 is fixed by the fixing nut 2. A hole is formed at a predetermined position of the metal plate 7 so that the tuning screw 1 may be inserted into the tuning groove of the dielectric resonance element 5 through the metal plate 7.

Meanwhile, the guide groove 9 formed into the bottom of the housing 4 may have a dual-groove structure through additional formation of an air gap groove 10, as illustrated in FIG. 4. This air gap groove 10 prevents non-uniform contact of the lower end surface of the dielectric resonance element 5 caused by processing tolerance-incurred poor flatness or -rough processed surface. Rather, the air gap groove 10 ensures stable contact of the lower end surface of the dielectric resonance element 5.

For assembly of the DR having the above configuration, the dielectric resonance element 5 is first inserted into the guide groove 9 at the center of the housing space formed by the cover 3 and the housing 4, the metal plate 7 is mounted on the dielectric resonance element 5, the cover 3 is engaged with the housing 4 by screwing or the like, and then the dielectric fixing screw 8 is tightened with an appropriate torque.

The above resonator structure according to the exemplary embodiment of the present invention allows for fabrication of a resonator without soldering. Therefore, processing is facilitated and additional soldering-caused tolerance generation or problems such as a characteristic change and failure can be reduced. In the above structure, the thin metal plate 7 inserted between the dielectric resonance element 5 and the dielectric fixing screw 8 plays an important role. If the dielectric resonance element 5 is pressed by tightening the dielectric fixing screw 8 without the metal plate 7, the dielectric resonance element 5 may rotate along with the rotation of the dielectric fixing screw 8, resulting in damage to the dielectric resonance element 5. In addition, a discontinuous surface between the dielectric fixing screw 8 and the cover 3 that may exist without the metal plate 7 degrades the characteristics of the resonator. Thus the use of the metal plate 7 blocks the influence of the discontinuous surface in the housing space.

It can be further contemplated as another exemplary embodiment of the present invention that the metal coatings 52 and 54 are not formed on the upper and lower surfaces of the dielectric resonance element 5. In this case, the assembly torque of the dielectric fixing screw 8 is more significant and determines the temperature characteristics of the resonator. Accordingly, the torque should be appropriately adjusted according to the correlation between the dielectric resonance element 5 and the housing 4.

Because the thermal expansion coefficient of a metal of which the housing 4 is formed of is very different from that of the dielectric resonance element 5 usually formed of a dielectric ceramic, the housing 4 is contracted or expanded more with a temperature change, thereby changing the characteristics of the resonator. Therefore, the dielectric fixing screw 8 should be tightened in such a manner that a dimension changeable by the contraction and expansion of the housing 4 and the cover 3 is compensated.

Also in this case, a final product that has been completely assembled in the last process is annealed for a predetermined time (e.g. three hours) at a high temperature (e.g. 80 to 1200 degrees in Celsius) and then subjected to frequency tuning in the same manner as for typical filters. In general, metal may undergo characteristic changes due to a metal stress during processing and assembly. The annealing stabilizes the characteristics of metal and thus the characteristics of the resonator can be maintained uniform despite the contraction and expansion of the housing 4 and the dielectric resonance element 5 with a temperature change.

All resonators of a filter usually have different resonance frequencies. To compensate the different resonance frequencies, frequency tuning is performed by the tuning screw 1. If the compensation is failed with use of the tuning screw 1, the resonance frequencies are tuned by differentiating the resonators in length or shape when designing them. According to the present invention, a resonance frequency can be adjusted by use of the air gap groove 10 that can be formed in the guide groove 9. That is, a resonance frequency can be tuned by changing the area or depth of the air gap groove 10. Thus, each DR can be freely designed.

Figure 6:
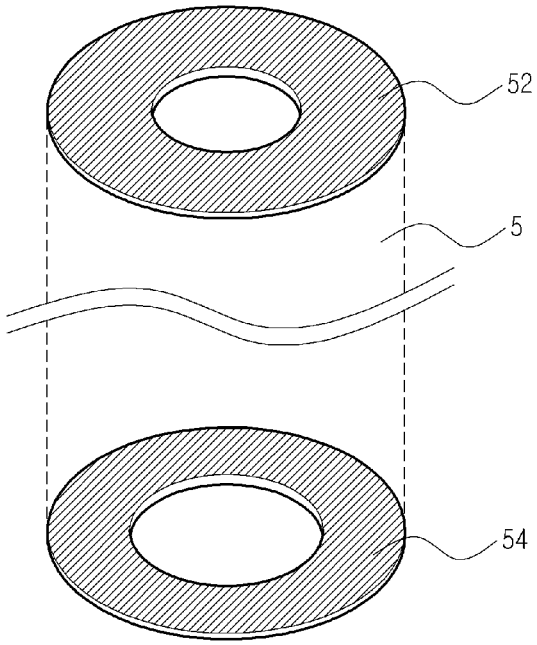
FIG. 6 illustrates a detailed structure of metal coatings formed on upper and lower surfaces of the dielectric resonance element illustrated in FIG. 3.
Figure 7:
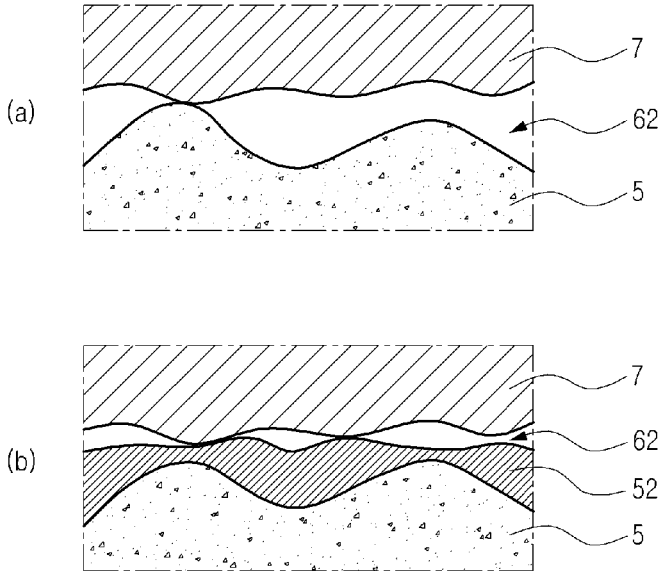
FIGS. 7A and 7B illustrate enlarged partial sections of a contact portion between a DR element and the upper metal coating according to exemplary embodiments of the present invention.

FIG. 6 illustrates a detailed structure of the metal coatings formed on upper and lower surfaces of the dielectric resonance element illustrated in FIG. 3, and FIGS. 7A and 7B illustrate enlarged partial sections of a contact portion between the dielectric resonance element and the upper metal coating according to exemplary embodiments of the present invention. Specifically, FIG. 7A illustrates the absence of a metal coating on the upper surface of the dielectric resonance element and FIG. 7B illustrates the presence of the metal coating 52 on the upper surface of the dielectric resonance element.

Referring to FIGS. 6, 7A and 7B, the metal coating 52 (FIG. 6, 7B) or 54 (FIG. 6) make a contact surface uniform at the contact portion between the dielectric resonance element 5 and the metal plate 7 (FIGS. 7A, 7B) or between the dielectric resonance element 5 and the guide groove 9, as illustrated in FIG. 3, formed into the bottom of the housing 4, as illustrated in FIG. 3, thereby preventing characteristic degradation. For the convenience's sake of description, FIGS. 7A and 7B are more or less exaggerated. As illustrated in FIGS. 7A and 7B, the contact surface between the upper surface of the dielectric resonance element 5 and the metal plate 7 includes an air layer 62 because they are not perfectly brought into close contact due to a fine tolerance caused by an actual flatness, thus causing characteristic degradation. The metal coatings 52 and 54 increase the flatness of the contact surfaces, greatly suppressing generation of the air layer 62. Furthermore, when the dielectric resonance element 5 is pressed to be fixed, the contact is more tightened.

While the metal coating 54 may be formed all over the lower surface of the dielectric resonance element 5, it may also be shaped into a donut, as illustrated in FIG. 6. With the thus-configured metal coating 54, a resonance frequency can be adjusted. That is, a resonance frequency can be tuned by changing the area of the empty space of the metal coating 54.

A DR in an RF filter according to an exemplary embodiment of the present invention can be implemented as described above. While the invention has been shown and described with reference to certain exemplary embodiments of the present invention thereof, it will be understood by those skilled in the art that various changes in form and details may be made therein without departing from the spirit and scope of the present invention as defined by the appended claims and their equivalents.

The invention claimed is:

1. A method for assembling a dielectric resonator in a radio frequency filter, the method comprising:

fixedly inserting a rod-shaped dielectric resonance element into a guide groove formed into a bottom of a housing at the center of a housing space formed by a cover and the housing;

interposing a metal plate between the cover and the housing and engaging the cover with the housing; and tightening a dielectric fixing screw with a predetermined torque, the dielectric fixing screw being screwed with the cover at a position corresponding to an upper end portion of the dielectric resonance element, so as to press the metal plate against the upper end portion of the dielectric resonance element.

2. The method of claim 1, wherein at least one end of the dielectric resonance element is metalized.

3. The method of claim 1, further comprising performing annealing of the dielectric resonator at a predetermined high temperature for a predetermined time.

4. A dielectric resonator in a radio frequency filter, comprising:

a rod-shaped dielectric resonance element fixed at the center of a housing space formed by a cover and a housing;

a guide groove formed into a bottom of the housing, for allowing the dielectric resonance element to be inserted therein;

a metal plate interposed between the cover and the housing; and a dielectric fixing screw engaged with the cover at a position corresponding to an upper end portion of the dielectric resonance element by screwing, for fixing the dielectric resonance element by pressing the metal plate against the upper end portion of the dielectric resonance element.

5. The dielectric resonator of claim 4, wherein a tuning screw is engaged with the dielectric fixing screw for frequency tuning at a position corresponding to a tuning groove formed in the upper end portion of the dielectric resonance element, and the metal plate has a hole formed at a predetermined position so that the tuning screw is inserted into the tuning groove of the dielectric resonance element.

6. The dielectric resonator of claim 4, wherein at least one end of the dielectric resonance element is metalized.

7. The dielectric resonator of claim 4, wherein the guide groove further includes an air gap groove so that the guide groove has a dual-groove structure.

8. The dielectric resonator of claim 7, wherein a tuning screw is engaged with the dielectric fixing screw for frequency tuning at a position corresponding to a tuning groove formed in the upper end portion of the dielectric resonance element, and the metal plate has a hole formed at a predetermined position so that the tuning screw is inserted into the tuning groove of the dielectric resonance element.

9. The dielectric resonator of claim 7, wherein at least one end of the dielectric resonance element is metalized.

10. The dielectric resonator of claim 8, further comprising performing annealing of the dielectric resonator at a predetermined high temperature for a predetermined time.

11. A dielectric resonator in a radio frequency filter, comprising:

a rod-shaped dielectric resonance element fixed at the center of a housing space formed by a cover and a housing;

a guide groove formed into a bottom of the housing, for allowing the dielectric resonance element to be inserted therein, wherein the guide groove further includes an air gap groove so that the guide groove has a dual-groove structure, and a dielectric fixing screw engaged with the cover at a position corresponding to an upper end portion of the dielectric resonance element by screwing, for fixing the dielectric resonance element by pressing a metal plate against the upper end portion of the dielectric resonance element.

* * * * *